US006155340A

United States Patent [19]

Folkedal et al.

[11] Patent Number: 6,155,340

[45] Date of Patent: Dec. 5, 2000

[54] HEAT EXCHANGER

[75] Inventors: Leif Folkedal, Kopervik; Peter Grundlach, Raufoss; Jostein Pettersen, Ranheim, all of Norway; Liming Xu, Greenville, S.C.

[73] Assignee: Norsk Hydro, Oslo, Norway

[21] Appl. No.: 09/423,766

[22] PCT Filed: Oct. 23, 1997

[86] PCT No.: PCT/EP97/05985

§ 371 Date: Feb. 7, 2000

§ 102(e) Date: Feb. 7, 2000

[87] PCT Pub. No.: WO98/51983

PCT Pub. Date: Nov. 19, 1998

[30] Foreign Application Priority Data

May 12, 1997 [EP] European Pat. Off. ..... 97201385

[51] Int. Cl.[7] ..... F28F 9/04

[52] U.S. Cl. ..... 165/175; 165/176; 165/173; 165/153

[58] Field of Search ..... 165/144, 175, 165/173, 151, 176, 153

[56] References Cited

U.S. PATENT DOCUMENTS

| | | | |
|---|---|---|---|
| 4,386,652 | 6/1983 | Dragojevic | 165/144 |
| 4,770,240 | 9/1988 | Dawson et al. | 165/176 |
| 4,829,780 | 5/1989 | Hughes et al. | 165/176 X |
| 5,009,262 | 4/1991 | Halstead et al. | 165/173 X |
| 5,172,761 | 12/1992 | Lyon | 165/713 |
| 5,174,373 | 12/1992 | Shinmura | 165/176 |
| 5,307,871 | 5/1994 | Jalilevand et al. | 165/713 |

FOREIGN PATENT DOCUMENTS

| | | | |
|---|---|---|---|
| 4305060 | 8/1994 | Germany | 165/173 |
| 4-187991 | 7/1992 | Japan | 165/176 |

*Primary Examiner*—Leonard Leo

*Attorney, Agent, or Firm*—Gary M. Hartman; Domenica N. S. Hartman

[57] ABSTRACT

A heat exchanger comprises a plurality of flat tubes for heat exchange between a first fluid flowing inside the tubes and a second fluid flowing outside the tubes. A pair of hollow headers is connected to the ends of the flat tubes. An inlet and outlet are provided in the headers for introducing the first fluid into the flat tubes and discharging it therefrom. Each header is composed of at least two parallel tubes with substantially circular cross-section, two adjacent tubes having integrated wall portions, thereby providing a substantially flat header.

3 Claims, 2 Drawing Sheets

HEAT EXCHANGER

BACKGROUND OF THE INVENTION

The invention relates to a heat exchanger comprising a plurality of flat tubes for heat exchange between a first fluid inside said tubes and a second fluid flowing outside of said tubes, a pair of hollow headers connected to the ends of the flat tubes, an inlet and an outlet being provided in the headers for introducing the first fluid into the tubes and discharging it therefrom, each header being composed of at least two parallel tubes with circular cross-sections two adjacent tubes having common wall portions and all tubes of each header constituting a substantially flat array of tubes.

Such a heat exchanger is known from EP-A-0 608 439.

In conventional heat exchangers, such as e.g. disclosed in EP-A-0 359 358, the header consists of a tube with circular cross-section. These tubes have been provided with holes with a shape corresponding to the cross-section of the heat transfer tubes so as to accept the tube ends. This design proves to be very satisfactory with the traditional pressures used in this type of heat exchanger. Commonly at the low pressure side a pressure of 2,5–6 bar has been used, whereas at the high pressure side pressures between 15 and 30 bar are used. With the introduction of higher pressures, the wall thickness of the header has to be increased. This is especially true for heat exchangers using $CO_2$ at high pressure, where the low pressure is between 35–80 bar and the high pressure between 80 and 170 bar.

This increase in size of the headers has resulted in heat exchangers with large size and weight, which constitutes especially a disadvantage in heat exchanger to be used in mobile equipment such as passenger cars and the like.

The problem with respect to the strength of the header has been overcome by constructing the header as disclosed in EP-A-0 608 439.

In this header a number of parallel tubes has been provided each communicating with a number of heat exchanging tubes. A parallel flow is occurring between the different tubes of the header and the different heat exchanging tubes. A disadvantage of this system is that the pressure drops and therefor the flow patterns in the different available flow paths are all different. This leads to additional losses in pressure and irregularities in the flow which negatively influences the heat exchange.

SUMMARY OF THE INVENTION

It is therefore an object of the invention to provide a heal: exchanger which does not show the disadvantages mentioned above.

This and other objects are achieved in that a number of holes each with a dimension corresponding to the cross-sections of the flat tube is made in the flat surface of each header, and in that the ends of the flat tubes are only inserted in so far into the circular tubes that a communication passage is left between the parallel tubes constituting the header.

BRIEF DESCRIPTION OF THE DRAWINGS

In this way it becomes possible to ensure a cross-flow between the different flat tubes whereby the pressure between the different flow paths is equalised as will as the flow pattern.

DESCRIPTION OF THE PREFERRED EMBODIMENT

Referring to FIGS. 1 to 4, the illustrated heat exchanger includes a plurality of flat heat transfer tubes 1 stacked in parallel and corrugated fins 2 sandwiched between the flat tubes 1. The ends 1*a* of the tubes 1 are connected to headers 3 and 4. Each heat transfer tube may be made of extruded aluminium, having a flat configuration. Alternatively, the flat tubes can be multi-bored flat tubes, commonly called multiport tubes or else, electrically seamed tubes can be used. Multiport tubes may be made by extrusion, but otherwise it is possible to make such tubes by rolling from clad sheet, folding and brazing. Furthermore, it is possible to use a welded tube with an inserted baffle.

Figure 1:
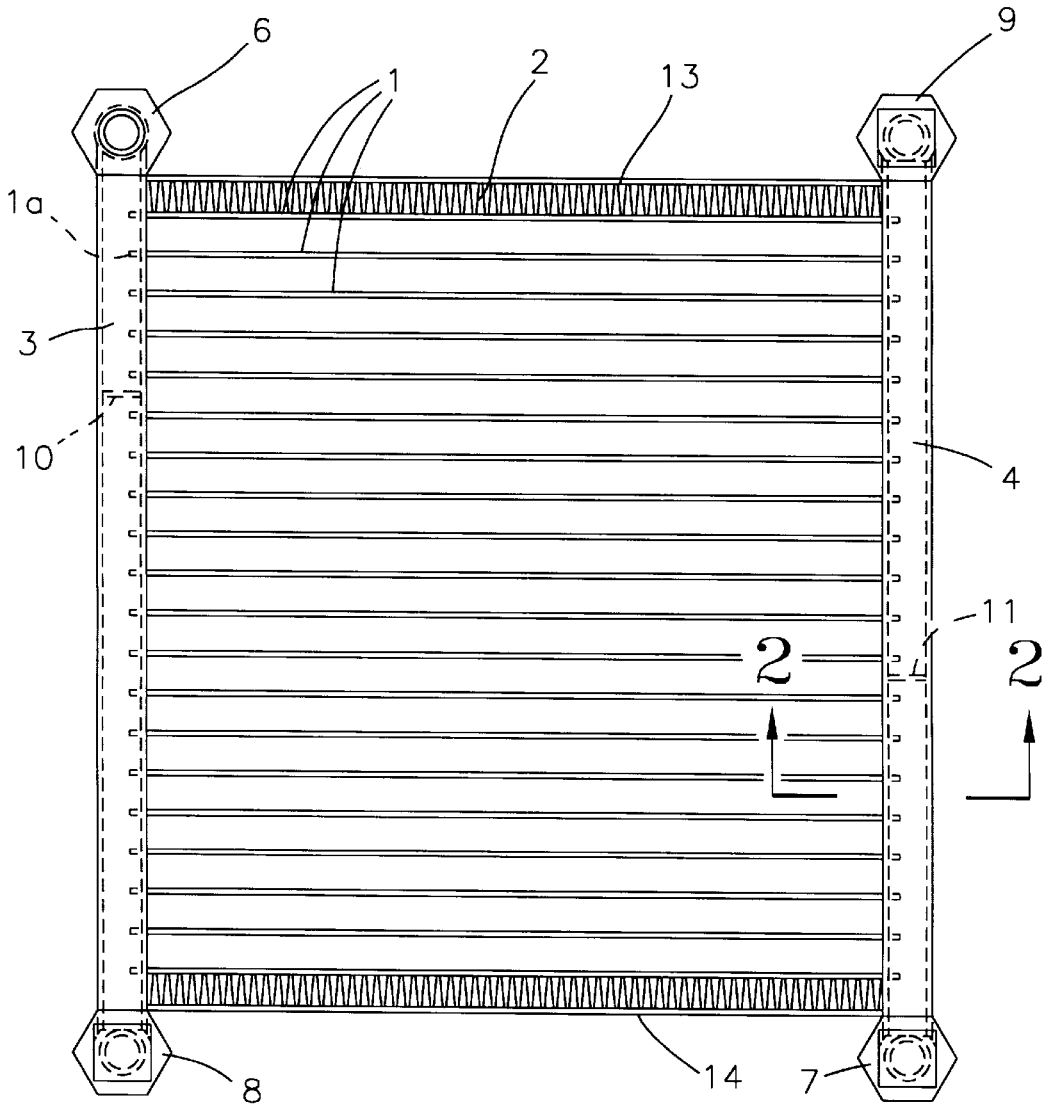
FIG. 1 is schematic view of a heat exchanger according to the invention.

In the embodiment shown each corrugated fin 2 has a width approximately similar to that of the flat tube 1 but other widths may be used as well. The fins 2 and the flat tubes 1 are brazed to each other. The headers 3,4 are made up of aluminium tubes with holes 5 of the same shape as the cross-section of the heat transfer tubes 1 so as to accept the tube ends 1*a*. The holes 5 can also be tailor made, e.g. conical, so as to allow easier access for the flat tubes. The inserted tube ends la are brazed in the holes 5. As shown in FIG. 1, the headers 3 and 4 are connected to an inlet manifold 6 and an outlet for the flat tubes. The inserted tube ends la are brazed in the holes 5. As shown in FIG. 1, the headers 3 and 4 are connected to an inlet manifold 6 and an outlet manifold 7, respectively. The inlet manifold 6 allows a heat exchanging fluid to enter the header 3, and the outlet manifold 7 allows the heat exchanging fluid to discharge. The headers 3 and 4 are closed with caps or plugs 8 and 9, respectively. The reference numerals 13 and 14 denote side plates attached to the outermost corrugated fins 2.

The header 3 has its inner space divided by a baffle 10 into two sections, and the header 4 is divided into two sections a baffle 11. In this way a medium path is provided starting from header 3, passing through a first set of tubes 1, through part of the header 4, passing through a second set of tubes 1 to header 3 and passing through a third set of tubes 1 to header 4 and to leave the heat exchanger unit through outlet 7. It is clear that these headers without baffles are also possible and otherwise headers with more than one baffle per header can be applied as well.

The heat exchanging fluid flows in zigzag patterns throughout the heat exchanger unit.

Figure 2:
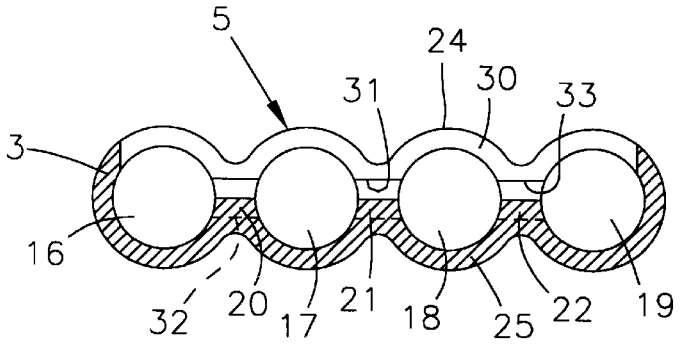
FIG. 2 is a cross-section according to the line II—II of the header, shown in FIG. 1.
Figure 3:
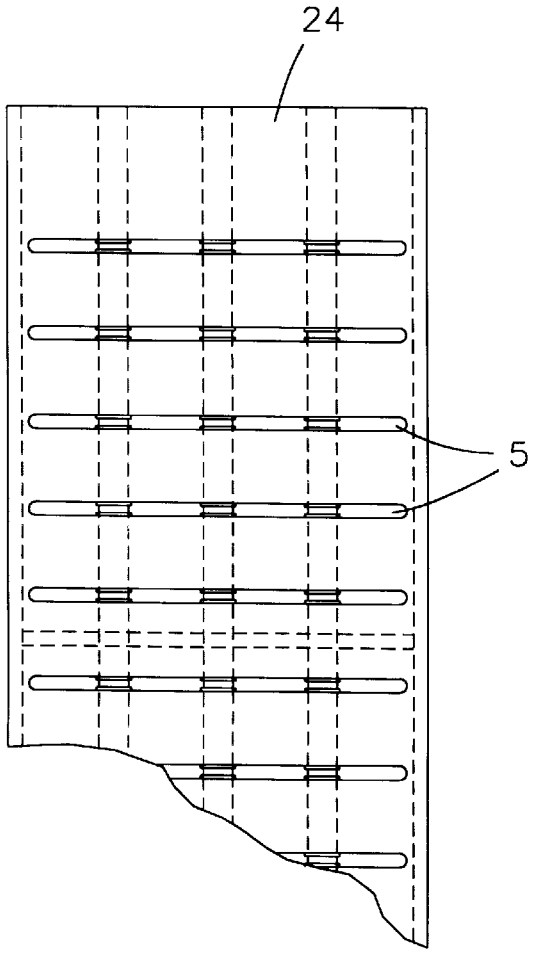
FIG. 3 is a front view of the header used in the heat exchanger of FIG. 1.
Figure 4:
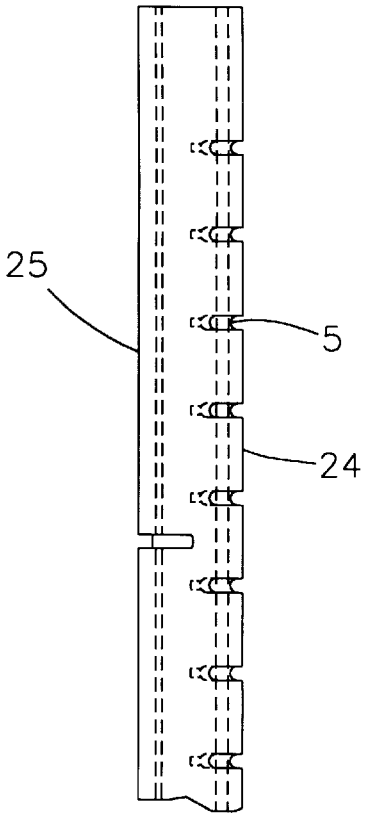
FIG. 4 is a side view of the header of FIG. 3 and FIG. 5 a front view of the header on enlarged scale according to FIG. 3, showing one hole in more detail.

The headers 3 and 4 are basicly identical and in the FIGS. 2–4 an example of a header 3 is shown in more detail. The header 3 consists in fact of a multiple port extruded tube and in the example shown four channels 16, 17, 18 and 19 are present. It is however clear that any number of channels may be present. The header 3 can be seen as being a number of tubes each forming one of the channels 16, 17, 18 and 19 and having wall portions 20, 21 and 22 which are common to two of these tubes. So the wall portion 20 is common for tubes forming the channels 16 and 17, the wall portion 21 for the tubes forming the channels 17 and 18 and the wall portion 22 for the tubes forming the channels 18 and 19. The wall portions 24 and 25 of the tubes which are more ore less perpendicular to the common wall portions 20, 21 and 22 are substantially in one plane and thereby form a substantially flat surface.

As more clearly shown in the FIGS. 3 and 4, the wall portion 24 of the header 3 is provided with a number of holes 5. These holes 5 have a cross-section which substantially correspond to outer-dimensions and shape of the cross-section of the flat tubes 1. These holes can be obtained by means of serrations or cut-outs. As shown in FIG. 2 these holes extend to a defined depth reaching the common wall portions 20, 21 and 22 where they end in a common flat surface 31. The end portions 1*a* of the tubes 1 can be inserted to that depth into the holes 5 and can be connected to the header 3 by one of the commonly known methods such as brazing. In this way a fluid connection can be obtained between the header 3 and the individual tubes 1. Preferably each hole is made with increased depth by adding material to the header.

In case the tube ends 1*a* of a multiple port extrusion tube are fully inserted up to the level of the surface 31 into the header 2, a number of channels of this multiple port extrusion tube are blocked by the wall portions 20, 21 and 22 and are not effective in the heat transfer process. It is possible to use a number of multiple port extrusion tubes fitting into each cut-out in front of the open part of the channels 16, 17, 18 and 19. As a rule this is cumbersome and preference is given to an obstruction of the channels in the multiple port heat transfer tube 1 which are opposite the wall portions 20, 21 and 22. Alternatively it is possible to increase the depth of the holes 5 up to the level of the surface indicated by 32. If the tubes 1 are now inserted up to the level of the surface 31 and fixed in that position a connection is obtained between the different channels 16, 17, 18 and 19 in the header 3. This may equalize the pressure and flow pattern between the different channels.

Figure 5:
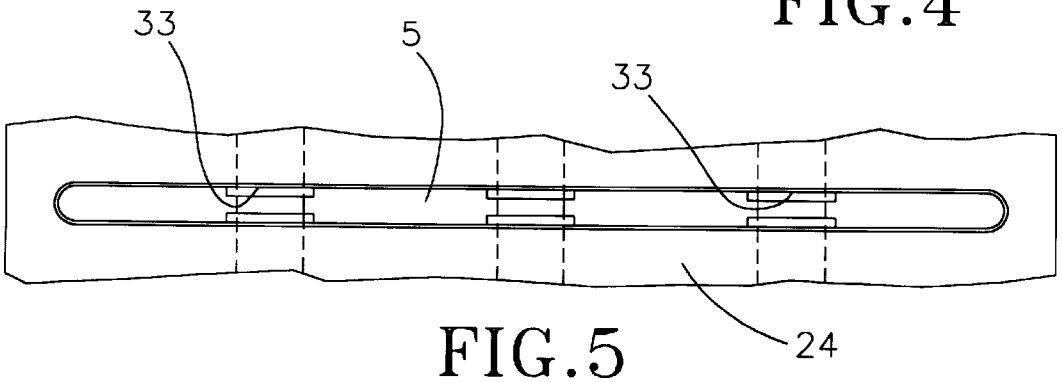

In order to facilitate the assembling and as shown in FIG. 5, it is possible to make the holes 5 in two stages. In a first stage the hole 5 is made on full width i.e. the thickness of the flat tubes 1, up to the level of surface 31. In a second stage the holes are made deeper on a reduced width i.e. appoximately the thickness of the flat tubes minus twice the wall thickness, up to the level of surface 32. As shown in FIG. 5 in this way a number of shoulders 33 is made in the header holes, allowing the tubes ends 1*a* to be inserted up till the level of surface 31 and being connected to the header, thereby having an open communication between the different channels of the header 3 or 4, and thus allowing a better cross-flow pattern between the channels.

The shoulders 33 have a defined length corresponding to the thickness of common wall 20, 21 or 22 between the different channels of the header 3 or 4, as seen in FIGS. 2 and 5. In case of connecting the tubes 1 with the headers 3 or 4 be means of brazing, it is possible that part of the brazing material is flowing on the surface of the shoulder 33 and into the inner channel of the tubes 1. In order to avoid this in-flow of brazing material it is possible to reduce the length of the shoulders to such an extent that only a very small portion of shoulder 33 is in contact with the tube end 1*a*.

It is clear that the invention is not restricted to the example described above but that modifications are possible within the same inventive concept which fall within the scope of the annexed claims. More especially it is possible to use two different headers, one with the tubes 1 fully inserted and one with the tubes 1 partially inserted in order to have the internal communication.

What is claimed is:

1. A heat exchanger comprising;

a plurality of flat tubes for heat exchange between a first fluid inside the tubes and a second fluid flowing outside the tubes, each of the tubes having a cross-section and a pair of ends;

a pair of hollow headers connected to the ends of the tubes, each header comprising a row of at least two parallel tubular portions with circular cross-sections and common wall portions therebetween, each header having a first face corresponding to a width of the header in a direction across the row of tubular portions each header having holes through the first face thereof and into the common wall portions of the tubular portions, each hole having a cross-section, corresponding to the cross-section of a corresponding one of the tubes, the ends of the tubes being inserted into the holes so that a communication passage exists between the tubular portions of the header; and an inlet and an outlet associated with the headers for introducing and discharging the first fluid from the heat exchanger.

2. A heat exchanger according to claim 1, wherein the tubes are extruded tubes with multiple parallel channels.

3. A heat exchanger according to claim 2, wherein at least one of the common wall portions blocks at least one of the channels of the extruded tube.

* * * * *